US006341944B1

(12) United States Patent
Butcher

(10) Patent No.: US 6,341,944 B1
(45) Date of Patent: Jan. 29, 2002

(54) MOTOR START AND FLOAT SWITCH ASSEMBLY

(75) Inventor: James A. Butcher, Ft. Wayne, IN (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/333,371

(22) Filed: Jun. 15, 1999

(51) Int. Cl.[7] ..... F04B 49/00
(52) U.S. Cl. ..... 417/41; 417/40
(58) Field of Search ..... 68/4; 337/104; 340/244; 318/482, 473; 417/12, 360, 40, 36; 137/57 D; 307/118; 200/84 B, 153 A

(56) References Cited

U.S. PATENT DOCUMENTS 3,568,121 A * 3/1971 Nash ..... 337/104
3,575,020 A * 4/1971 Hubbard ..... 68/4
3,634,842 A * 1/1972 Niedermeyer ..... 340/244
3,667,022 A * 5/1972 Quinn ..... 318/482
3,758,236 A * 9/1973 Zimmermann ..... 417/360
3,800,205 A * 3/1974 Zalar ..... 318/482
3,847,666 A * 11/1974 Jacobs ..... 134/57 D
4,262,216 A * 4/1981 Johnston ..... 307/118
4,278,858 A * 7/1981 Kaessen ..... 200/84 B
4,626,755 A * 12/1986 Butcher et al. ..... 318/473
4,629,841 A * 12/1986 Riback et al. ..... 200/153 A
5,015,152 A * 5/1991 Geeene ..... 417/40
5,076,762 A * 12/1991 Lykes et al. ..... 417/40
5,135,359 A * 8/1992 Dufresne ..... 417/36
5,216,288 A * 6/1993 Greene ..... 307/118
5,234,319 A * 8/1993 Wilder ..... 417/40
5,324,170 A * 6/1994 Anastos et al. ..... 417/12
5,923,102 A * 7/1999 Koenig et al. ..... 307/118

* cited by examiner

*Primary Examiner*—Teresa Walberg
*Assistant Examiner*—Leonid Fastovsky
(74) *Attorney, Agent, or Firm*—Damian Wasserbauer; Armstrong Teasdale LLP

(57) ABSTRACT

An electrical circuit connects an electric motor of a sump pump to a power source and controls the energization of a sump pump assembly. The assembly includes a motor circuit having a sump pump motor actuation switch and a main winding switch combined into switch assembly. The sump pump motor actuation switch actuates the main winding switch from a normally open position to a closed position, thus energizing the sump pump assembly.

20 Claims, 3 Drawing Sheets

MOTOR START AND FLOAT SWITCH ASSEMBLY

BACKGROUND OF THE INVENTION

This invention relates generally to sump pumps and, more particularly, to sump pump motor circuits for controlling sump pump motors.

There are many different types of sump pump motor circuits for use with a sump pump assembly to control a water level in a sump. Sump pump motor assemblies typically include a housing, a stator and a rotor assembly. The housing includes a shell and two end shields and encases at least a portion of the rotor assembly. The rotor assembly includes a rotor core and a rotor shaft coupled to a pump. Typically, the assembly also includes a run winding and a start winding. The start winding is energized during the initial excitation of the motor, and is de-energized as the motor reaches a predetermined operational speed. De-energization of the start windings is often accomplished by a centrifugal switch.

Sump pump motor assemblies also include, in addition to the centrifugal switch, a motor start windings switch and a sump pump actuator switch for controlling pump energization. The motor start windings switch energizes the pump when the water level in the sump reaches a predetermined level. The sump pump actuator switch de-energizes the pump when the water level in the sump is reduced below a predetermined depth.

Typically the sump pump actuation switch in these sump pump motor circuits is connected to a sump pump motor actuation switch mounted on an insulated circuit board assembly. The sump pump motor actuation switch is quick-connected to the motor start and motor main windings with two electrical leads permanently attached to the windings. A motor start switch is also required and is mounted to a separate insulated circuit board assembly. The motor start switch assembly is also quick-connected to the sump pump separate switch assemblies are required which increase the cost of manufacturing, increase the required assembly times, and increase the probability of mechanical or electrical failure occurring within the sump pump assembly.

Accordingly, it would be desirable to provide a more cost-effective and efficient sump pump assembly. In addition, it would be desirable to provide a sump pump motor circuit that is reliable, simple to assemble, and also cost-effective.

BRIEF SUMMARY OF THE INVENTION

In an exemplary embodiment of the invention, a sump pump motor circuit that is easy to assemble controls the energization of a sump pump assembly in a reliable manner.

The sump pump assembly includes a sump pump motor circuit including a sump pump motor actuation switch and a main winding switch. The two switches are included in one switch assembly and as such, only one switch assembly requires mounting hardware and fasteners. The switch assembly is electrically connected between a motor main winding and a power source, and controls the energization of the sump pump assembly without requiring additional switches, mounting fasteners, or mounting brackets.

Additionally, the switch assembly is connected to the motor windings using quick connect leads. The switch assembly includes five quick connect terminals which are sized to permit the proper connections with the sump pump assembly. The quick connect terminals mate with specifically sized receiving terminals which are attached to the motor windings.

The sump pump assembly requires fewer motor leads, switches, and electrical connections than known switch assemblies. As a result of fewer electrical connections, the probability of mechanical or electrical failure occurring within the sump pump assembly is reduced. Furthermore, the assembly of the sump pump motor circuit is not only simplified, but is more cost-effective than known sump pump assembly circuits.

DETAILED DESCRIPTION OF THE INVENTION

Figure 1:
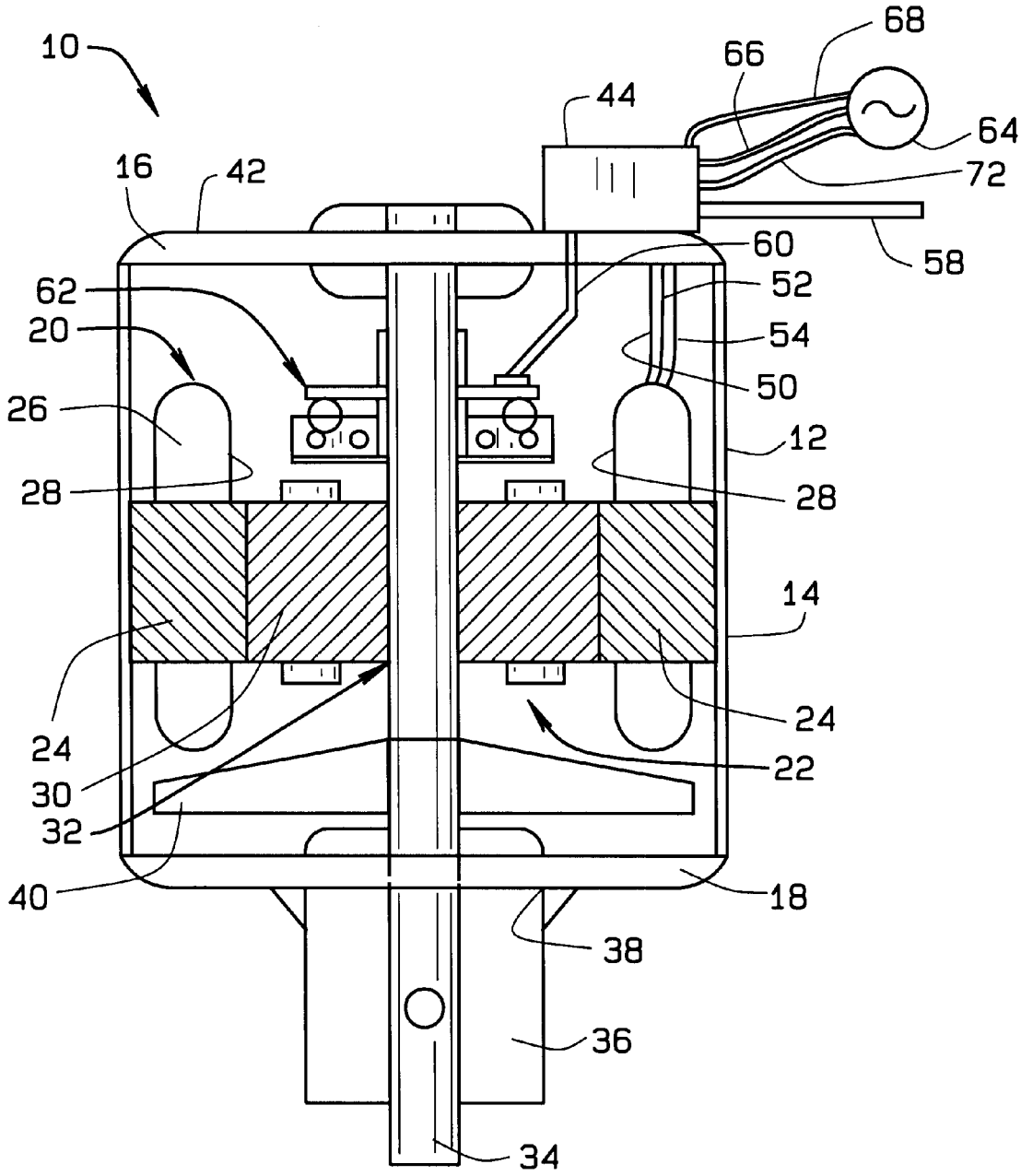
FIG. 1 is a side view of a sump pump motor assembly in accordance with one embodiment of the present invention.

FIG. 1 is a side view of a sump pump motor assembly 10 including a housing 12 including a shell 14. Shell 14 includes a first end shield 16 and a second end shield 18, which are mounted to shell 14. Motor assembly 10 includes a stator assembly 20 and a rotor assembly 22. Stator assembly 20 includes a stator core 24, a plurality of stator windings 26, and a stator bore 28 extending through stator core 24. Stator windings 26 are positioned circumferentially around stator bore 28. Rotor assembly 22 includes a rotor core 30, a rotor bore 32 extending therethrough, and a rotor shaft 34 positioned within rotor bore 32.

A mounting hub 36 is located adjacent an opening 38 which extends through second end shield 18. Rotor shaft 34 extends through opening 38 and is coupled to a pump impeller (not shown). Motor 10 is cooled by cooling fan 40 mounted on rotor shaft 34.

End shield 16 includes an outer surface 42 upon which a sump pump float switch housing 44 is mounted. A switch assembly (not shown in FIG. 1) is positioned within housing 44 and is electrically connected to a set of three stator winding leads 50, 52, and 54 of motor 10. A sump pump motor actuation switch 58 is electrically connected to the switch assembly within housing 44 and is connected to a float (not shown). An actuator lever 60 is mechanically connected between a centrifugal actuator mechanism 62 and the switch assembly. Centrifugal actuator mechanism 62 is positioned on rotor shaft 34 within shell 14.

A power source 64 includes leads 66 and 68 which electrically connect to the switch assembly to supply power thereto. Additional lead 72 is not connected to the switch assembly as will be described in detail below.

Sump pump motor assembly 10 is typically installed in sumps that accumulate drainage which should not exceed a certain level. Sump pump motor assembly 10 prevents a level of drainage from exceeding a certain level. Sump pump motor assembly 10 is positioned so that, as the drainage level rises, the float connected to sump pump motor actuation switch 58 moves upwardly and actuates the switch assembly. When motor 10 is energized, windings 26 generate a rotating magnetic field that causes rotor shaft 34 to rotate and thereby cause the rotation of the sump pump impeller (not shown). As motor 10 reaches operating speeds, centrifugal mechanism 62 is actuated and the motor start windings (not shown) are cut-out while the motor main windings (not shown) remain energized.

Figure 2:
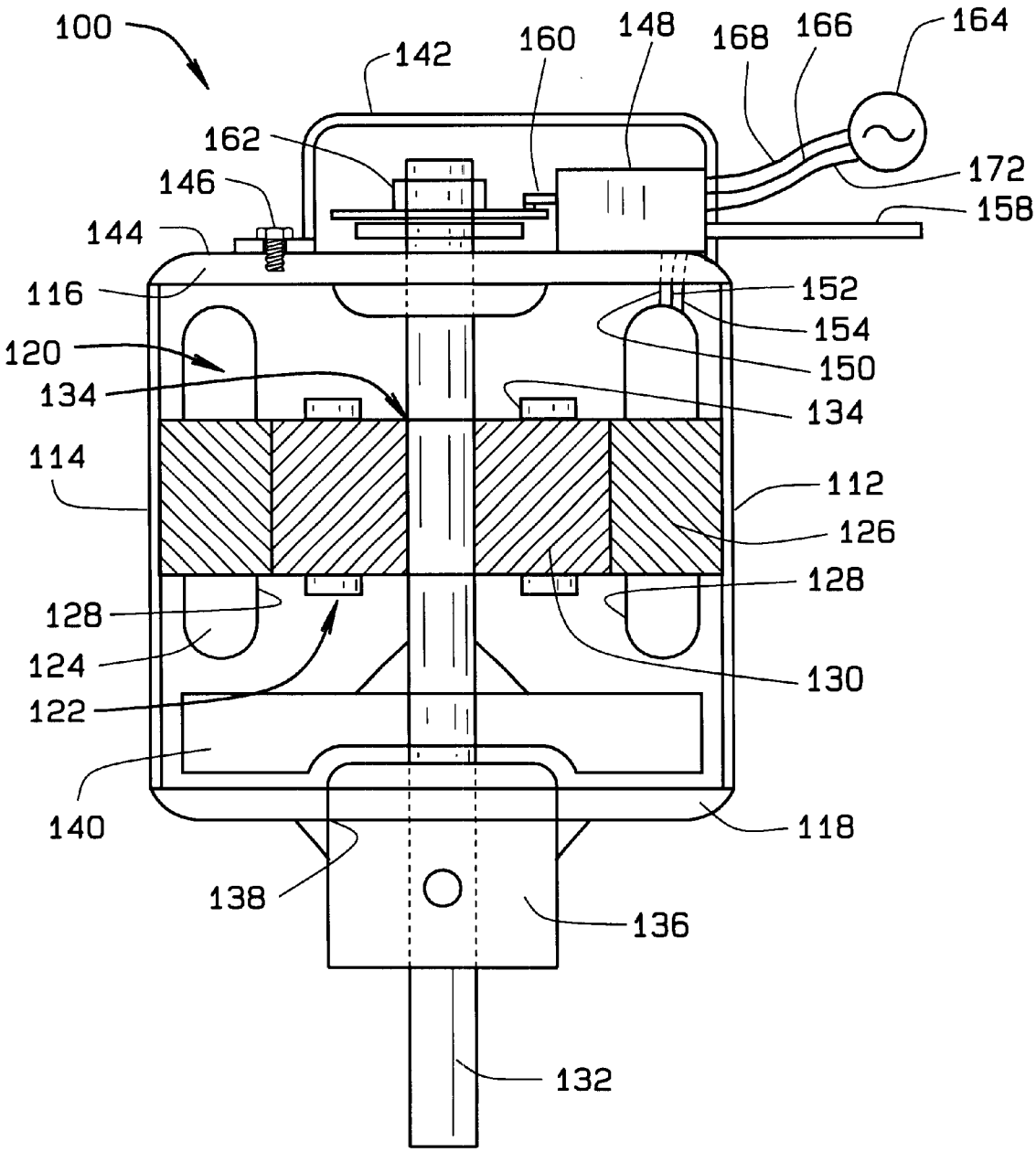
FIG. 2 is side view of a sump pump motor assembly in accordance with a second embodiment of the present invention.

FIG. 2 is a side view of an alternative embodiment of a sump pump motor assembly 100 including a housing 112 having a shell 114. A first end shield 116 and a second end shield 118 are mounted to shell 114. Sump pump assembly 100 also includes a stator assembly 120 and a rotor assembly 122. Stator assembly 120 includes a plurality of windings 124 including a start winding (not shown) and a run winding (not shown), a stator core 126, and a stator bore 128 extending through stator core 126. Stator windings 124 are positioned circumferentially around stator bore 128. Rotor assembly 122 includes a rotor core 130, a rotor shaft 132, and a rotor bore 134 extending through rotor core 130. Rotor shaft 132 is positioned within rotor bore 134.

A mounting hub 136 is positioned adjacent an opening 138 in second end shield 118. Rotor shaft 132 extends through opening 138 and is coupled to a pump impeller (not shown). Cooling fan 140 controls the temperature of motor 100 and is mounted on rotor shaft 132 within shell 114.

A protective housing 142 is mounted on an outer surface 144 of end shield 116 and is secured thereto by means of threaded fasteners 146. Sump pump float switch housing 148 is mounted to end shield 116 and is positioned within protective housing 142. Sump pump float switch housing 148 encases a switch assembly (not shown in FIG. 2). A set of three stator winding leads, 150, 152, and 154 electrically connect the switch assembly (not shown) to motor 100. A sump pump motor actuator switch 158 is electrically connected within sump pump float switch housing 148 to the switch assembly (not shown). Sump actuator switch 158 may also be connected to a float (not shown).

An actuator lever 160 is electrically connected between the switch assembly (not shown) positioned within sump pump float switch housing 148 and a centrifugal actuator mechanism 162. Centrifugal actuator mechanism 162 is positioned on pump drive shaft 132 between protective housing 142 and end shield 116.

A power source 164 is electrically connected to the switch assembly (not shown) with leads 166 and 168. Additional lead 172 is not connected to the switch assembly, but instead by-passes the switch assembly (not shown) and is connected to a grounding lug (not shown) within sump pump switch housing 148. The connection of lead 172 ensures that any external metallic parts (not shown) of sump pump motor assembly 100 will be grounded.

Sump pump motor assembly 100 is typically located in a sump that accumulates drainage which should not exceed a certain level. Sump pump motor assembly 100 prevents the drainage from exceeding that level. Sump pump assembly 100 is positioned so that, as the water level rises, a float (not shown) connected to sump actuation switch 158 will move upwardly and will actuate the switch assembly (not shown). As motor 100 is energized, windings 124 create a rotating magnetic field which causes rotor shaft 132 to rotate and thereby rotate the sump pump impeller (not shown). As motor 100 reaches operating speeds, centrifugal mechanism 162 will be actuated and the motor start windings (not shown) will be cut-out and the motor main windings (not shown) will remain energized.

Figure 3:
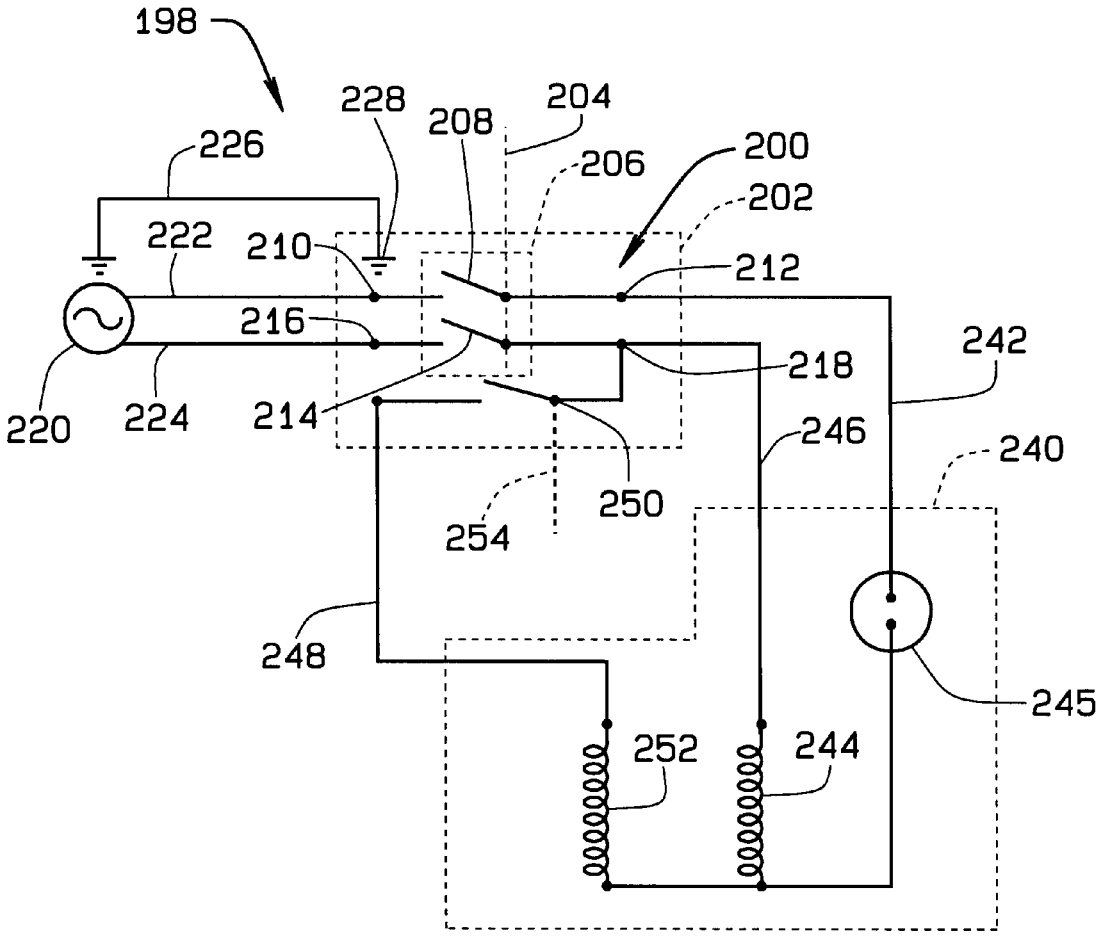
FIG. 3 is a circuit schematic of a switch assembly for the sump pump motor assembly shown in FIG. 1.

FIG. 3 is a circuit schematic of a motor circuit 198 for a sump pump motor assembly (not shown), such as sump pump motor assembly 10 shown in FIG. 1. Motor circuit 198 includes a sump pump switch assembly 200 which is enclosed within a switch housing 202. Switch assembly 200 includes a sump pump motor actuation switch 204 located within switch housing 202 and a main winding switch assembly 206 also located within switch housing 202. Sump pump motor actuation switch, or float switch, 204 is connected to main winding switch assembly 206. Main winding switch assembly 206 includes first main winding switch 208, electrically connected between a first quick disconnect terminal 210 and a second quick disconnect terminal 212. Main winding switch assembly 206 also includes a second main winding switch 214 electrically connected between a third quick disconnect terminal 216 and a fourth quick disconnect terminal 218. Sump pump motor actuation switch 204 is adjustable to control the fluid level in a sump such that when elevated, sump pump motor actuation switch 204 can simultaneously actuate first main winding switch 208 and second main winding switch 214 from the open positions to closed positions which energizes motor circuit 198.

A source of electrical power 220 is electrically connected to switch assembly 200. A first power lead 222 is electrically connected within switch housing 202 to first terminal 210. A second power lead 224 electrically connects power supply 220 to a third terminal 216. Lead 226, similar to lead 72 shown in FIG. 1, extends from a source of ground potential at power supply 220, by-passes switch assembly 200, and is connected to a grounding lug 228 located within switch housing 202. The connection of lead 226 ensures that any external metallic parts (not shown) of motor 10 will be grounded.

Switch assembly 200 is also electrically connected to a motor (not shown) positioned within motor housing 240. A first motor lead 242 is electrically connected between second terminal 212 and a motor main winding 244. A thermal protector 245 is electrically connected between motor main winding 244 and first main winding switch 208. Thermal protector 245 can be a conventional thermally activated switch which will open in response to a predetermined temperature of motor main winding 244. A second motor lead 246 extends from motor housing 240 and is electrically connected between fourth terminal 218 and motor main winding 244. A third motor lead 248 extends from motor housing 240 and is electrically connected between a fifth quick disconnect terminal 250 positioned within switch assembly 200 and a motor start winding 252. A centrifugal mechanism switch 254 is electrically connected in circuit 198 between motor start winding 252 and fifth terminal 250. Centrifugal mechanism switch 254 is normally closed and actuates a centrifugal mechanism (not shown). As the motor (not shown) is initially energized, motor start winding 252 and motor main winding 244 are energized. When the motor reaches operating speeds centrifugal mechanism switch 254 opens and disconnects motor start winding 252 from the source of electrical power 220.

The present invention provides a motor circuit for a sump pump having a minimum number of electrical circuit connections. The circuit is inexpensive, simple, and quick to assemble as compared to known sump pump motor circuits. As such, a cost effective sump pump assembly is provided.

While the invention has been described in terms of various specific embodiments, those skilled in the art will recognize that the invention can be practiced with modification within the spirit and scope of the claims.

What is claimed is:

1. A switch assembly for a sump pump, said switch assembly comprising:

a sump pump motor actuation switch;

at least one main winding switch configured to be connected between a motor main winding and a power source, said actuation switch connected to said at least one main winding switch, said actuation switch configured to actuate said at least one main winding switch from an open position to a closed position; and a start winding switch configured to be connected between a motor start winding and the power source, said start winding switch electrically coupled in parallel with said motor main winding.

2. A switch assembly in accordance with claim 1 wherein said at least one main winding switch comprises a first main winding switch and a second main winding switch, said second main winding switch positioned between said start winding switch and the power source.

3. A switch assembly in accordance with claim 2 wherein said first main winding switch is configured to be connected to a thermal protector.

4. A switch assembly in accordance with claim 2 wherein said start winding switch is configured to be actuated by a centrifugal mechanism.

5. A switch assembly in accordance with claim 1 wherein said actuation switch comprises a float switch.

6. A switch assembly in accordance with claim 2 further comprising a first terminal and a second terminal, said first terminal connected to said first main winding switch and configured to be connected to the power source, said second terminal connected to said first main winding switch and configured to be connected to a first lead extending from the main winding.

7. A switch assembly in accordance with claim 6 further comprising a third terminal and a fourth terminal, said third terminal connected to said second main winding switch and configured to be connected to the power source, said fourth terminal connected to said second main winding switch and configured to be connected to a second lead extending from the main winding.

8. A switch assembly in accordance with claim 7 further comprising a fifth terminal connected to said start winding switch, said fifth terminal configured to be connected to a third lead extending from the start winding.

9. A sump pump comprising:

a motor comprising a main winding and a start winding; and a switch assembly for controlling energization of said sump pump, said switch assembly comprising a sump pump motor actuation switch, at least one main winding switch connected to said motor main winding and configured to be connected to a power source, said actuation switch connected to said at least one main winding switch and configured to actuate said at least one main winding switch from an open position to a closed position, and a start winding switch connected to said motor start winding and configured to be connected to the power source, said start winding switch electrically coupled in parallel with said motor main winding.

10. A sump pump in accordance with claim 9 wherein said actuation switch comprises a float switch connected to said at a least one main winding switch, said at least one main winding switch comprising a first main winding switch and a second main winding switch.

11. A sump pump in accordance with claim 10 wherein said second main winding switch is connected to said start winding switch and is configured to be connected to the power source.

12. A sump pump in accordance with claim 10 wherein said motor further comprises a centrifugal mechanism, said start winding switch configured to be actuated by said centrifugal mechanism.

13. A sump pump in accordance with claim 10 wherein said motor further comprises a first lead extending from said main winding, said switch assembly further comprising a first terminal and a second terminal, said first terminal connected to said first main winding switch and configured to be connected to the power source, said second terminal connected to said first main winding switch and to said first lead.

14. A sump pump in accordance with claim 13 wherein said motor further comprises a second lead extending from said main winding, said switch assembly further comprising a third terminal and a fourth terminal, said third terminal connected to said second main winding switch and configured to be connected to the power source, said fourth terminal connected to said second main winding switch and to said second lead.

15. A sump pump in accordance with claim 13 wherein said motor further comprises a third lead extending from said start winding, said switch assembly further comprising a fifth terminal connected to said start winding switch and to said third lead.

16. A method for controlling the fluid level in a sump utilizing a sump pump, the sump pump including a motor and a switch assembly, the motor including a motor main winding and a start winding, the switch assembly including a sump pump motor actuation switch, at least one main winding switch, and a start winding switch, said start winding switch electrically coupled in parallel with said motor main winding, said method comprising the steps of:

installing a sump pump in a pump;

adjusting the actuation switch to energize the motor when the fluid reaches a selected level; and connecting the switch assembly to a power source.

17. A method in accordance with claim 16 wherein the motor further includes a centrifugal mechanism, said method further comprises the step of positioning the switch assembly so that the start winding switch is actuated by the centrifugal mechanism when the rotor attains a selected rotational speed.

18. A method in accordance with claim 16 wherein said method further comprises the step of connecting the at least one main winding switch between the motor main winding and the power source.

19. A method in accordance with claim 16 wherein said method further comprises the step of connecting the actuation switch to the at least one main winding switch so that the actuation switch actuates the at least one main winding switch from an open position to a closed position.

20. A method in accordance with claim 16 wherein said method further comprises the step of connecting the start winding switch between a motor start winding and the power source.

* * * * *

UNITED STATES PATENT AND TRADEMARK OFFICE

CERTIFICATE OF CORRECTION

PATENT NO. : 6,341,944 B1
DATED : January 29, 2002
INVENTOR(S) : Butcher

It is certified that error appears in the above-identified patent and that said Letters Patent is hereby corrected as shown below:

Column 6,
Line 37, delete "installing a" and insert therefor -- installing the --.

Signed and Sealed this

Fourth Day of November, 2003

JAMES E. ROGAN
*Director of the United States Patent and Trademark Office*